United States Patent [19]

Gross

[11] Patent Number: 4,569,649

[45] Date of Patent: Feb. 11, 1986

[54] MACHINE FOR MAKING EARTH BLOCKS

[76] Inventor: Robert Gross, 175 Drennen Rd., Orlando, Fla. 32806

[21] Appl. No.: 684,664

[22] Filed: Dec. 21, 1984

[51] Int. Cl.[4] ..... B30B 1/00; B28B 3/00

[52] U.S. Cl. ..... 425/344; 425/425; 425/432; 425/434; 425/256

[58] Field of Search ..... 425/344, 256, 425, 432, 425/434

[56] References Cited

U.S. PATENT DOCUMENTS

| | | | |
|---|---|---|---|
| 3,824,060 | 7/1974 | Helmrich et al. | 425/925 |
| 4,111,627 | 9/1978 | Kitahara | 425/432 X |
| 4,119,692 | 10/1978 | Durinck | 425/432 X |
| 4,259,054 | 3/1981 | Savage | 425/344 |
| 4,395,213 | 7/1983 | Springs | 425/432 X |
| 4,445,839 | 5/1984 | Crane | 425/425 X |

*Primary Examiner*—J. Howard Flint, Jr.

*Attorney, Agent, or Firm*—Pearne, Gordon, Sessions, McCoy, Granger & Tilberry

[57] ABSTRACT

A machine which makes building blocks from earth efficiently and rapidly has a pair of block forming molds at each end of the machine for simultaneously forming blocks at each end by means of a pair of rams. The hydraulic cylinder which actuates the two rams is located away from the axis between the two rams. The use of two molds eliminates wasted motion of the machine as a block is formed at one end of the machine as the ram is being retracted from the other end.

15 Claims, 7 Drawing Figures

MACHINE FOR MAKING EARTH BLOCKS

BACKGROUND OF THE INVENTION

1. Field of the Invention

This invention relates to a portable hydraulic press for making building blocks from earth, and more particularly to a machine which makes such blocks rapidly and inexpensively.

2. Description of the Prior Art

The use of earthen blocks as a building material to form structures has been known for thousands of years. Recently, there has been renewed interest in building structures of earthen blocks because of the ready availability of the earth and because of the unique properties of earth which makes it an ideal building material. Earth is available in unlimited supply at no expense, and it is available at the site of construction. In addition, earth is non-toxic, non-allergenic, fireproof, and soundproof. The high insulation properties also enhance its desirability as a building material.

The earth available at the building site has traditionally been fashioned into building blocks using one of two different methods. The first method is to form the earth into a permanent block using relatively low pressures, and then to dry the block in the sun to set the block in shape. The earth is often mixed with straw. This method is commonly known as adobe. The adobe construction requires molding and prebaking in the sun which requires considerable time and favorable weather.

The second method requires compression of the earth in a suitable machine having a high pressure ram. In order to form the earth into building blocks, it is necessary to provide a machine which is portable and which is capable of providing high pressures to form the earth into a solid block. Pressures of up to 3,000 psi (210 kg./sq. cm.) may have to be produced in order to form a solid earth block from the variety of types of earth available around the world. However, it is difficult to achieve such a high pressure in a portable machine using a small lightweight hydraulic cylinder.

Machines capable of producing such high pressures are often very slow because the hydraulic ram capable of producing high pressures usually operates at a very slow speed. Therefore, the production rates of such high pressure machines are usually fairly low. Such a machine should eliminate wasted motion as much as possible, and it should be relatively fast so that the earth blocks can be produced rapidly.

Although earth is available in unlimited supply free of charge, the cost of providing earth blocks may be drastically increased due to the cost of forming the earth into blocks. Therefore, a machine for forming building blocks of earth should be highly efficient to reduce the cost of forming the blocks as much as possible and take advantage of the low cost quality of earth building blocks. Such a machine should be as efficient as possible in order to keep fuel prices to a minimum so that low cost production can be achieved. When using the hydraulics, the hydraulic supply should be kept as close as possible to the cylinder so that friction losses are reduced as much as possible. The hydraulic line should also be free of sharp curves in order to reduce losses in the hydraulic lines.

While such a machine should be operating rapidly with very high pressures, it is necessary for such a machine to be relatively simple to operate. The machine should operate automatically and be capable of operation by semi-skilled labor, so that the machine can operate with little supervision and with a minimum number of operators. The requirement of a skilled operator or of multiple operators increases the costs of operating the machine and thereby defeats the low cost advantage of using earth as a building material.

SUMMARY OF THE INVENTON

The present invention provides a machine for making earth building blocks which overcomes the disadvantages of the prior art and provides the desired qualities of an earth block making machine in producing building blocks made from earth rapidly and inexpensively. The machine of the present invention avoids wasted motion by forming blocks at both ends of the machine. When the ram is retracted at one end of the machine, this motion is used to form the block at the other end of the machine. Therefore, the retraction of the ram does not result in any wasted motion, but instead this motion is used as a ramming motion to form a block at the other end of the machine. Thus, the machine of the present invention utilizes a dual-action hydraulic ram in which blocks are efficiently produced at both ends of the machine.

The dual action of the hydraulic cylinder coupled with the high pressures under which the machine operates would ordinarily require that a large, heavy hydraulic cylinder be used. However, this would not be appropriate in a small portable machine. Therefore, the machine of the present invention uses a heavy, sturdy slide assembly in which a slide member connects the two ram heads which are used to form the blocks, and the slide member is supported on a frame. The hydraulic cylinder is mounted beneath the frame out of the line between the two ram heads, so that the cylinder is not subjected directly to the heavy forces produced along the line between the ram heads. Therefore, a smaller hydraulic cylinder can be used to achieve the required high pressures.

The machine of the present invention is highly efficient with the hydraulic supply being provided in close proximity to the ram so that hydraulic pressure losses are reduced as much as possible.

The machine of the present invention produces earth blocks very rapidly even at high pressures by the use of dual hydraulic pumps which are together capable of producing both high pressures and high velocity. This is accomplished by the use of a high pressure pump and a high displacement pump coupled together with an appropriate actuating mechanism so that the high displacement pump is used to move the hydraulic ram rapidly from one end of the machine to the other, and the high pressure pump is used during the final block forming process to produce the high pressures necessary to form a solid earth block. The machine of the present invention can produce hydraulic pressures of 3,000 psi (210 kg./sq. cm.) during the final stages of the block formation, so that the blocks produced by the machine of the present invention are strong and suitable for use in earthen structures immediately after production by the machine.

The machine of the present invention uses a solid state control apparatus to automatically sequence the machine through the necessary steps and avoid machine malfunctions. Thus, the machine is capable of being operated automatically by a semi-skilled operator to produce the blocks using high pressure at a very rapid rate without operator intervention. The control system is microprocessor controlled and includes the use of sensors in the machine to assure that the operating eements of the machine are positioned appropriately before an action is undertaken.

Due the high efficiency of the machine of the present invention, fuel costs are reduced as much as possible, and earthen blocks may be produced very inexpensively.

These and other advantages are accomplished by the present invention of a machine for making blocks from earth. The machine comprises a pair of block forming molds and a pair of reciprocal ram heads. Each of the heads is capable of being moved between a retracted position in which the head is removed from the molds and earth can fall into the mold, and an advance position in which the head is moved into one of the molds and earth in the mold is compressed to form a block. A slide member connects the two ram heads. One of the heads is attached to each end of the slide member. The slide member is longitudinally movable to simultaneously move one ram head to its advanced position and the other ram head to its retracted position. There is a support frame upon which the slide member is mounted for longitudinal movement. A dual-action hydraulic cylinder having an internal piston is provided. The cylinder and the piston are attached to the slide member in the support frame to move the slide member longitudinally with respect to the support frame. The cylinder is mounted away from the axis between the ram heads.

DETAILED DESCRIPTION OF THE PREFERRED EMBODIMENT

Figure 1:
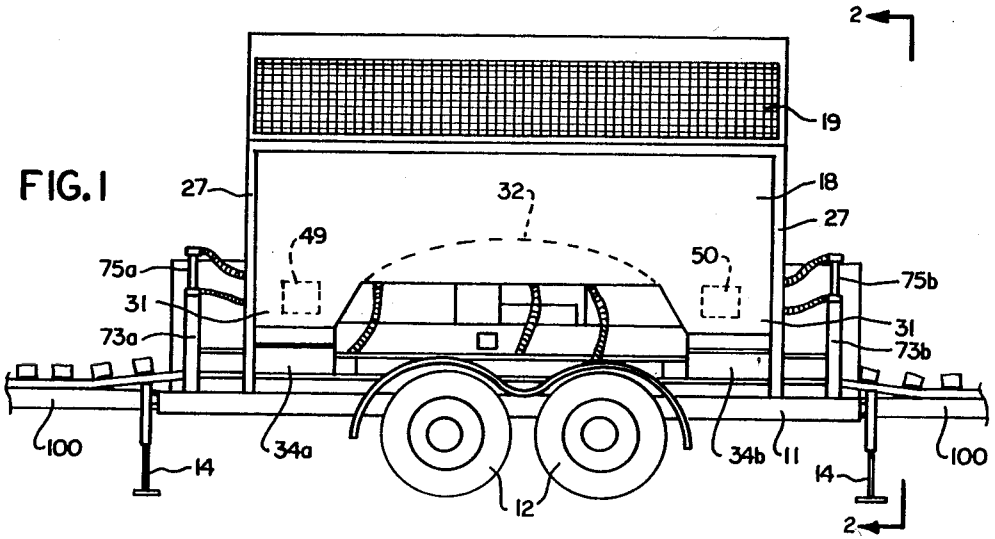
FIG. 1 is a side elevational view of the machine of the present invention.
Figure 3:
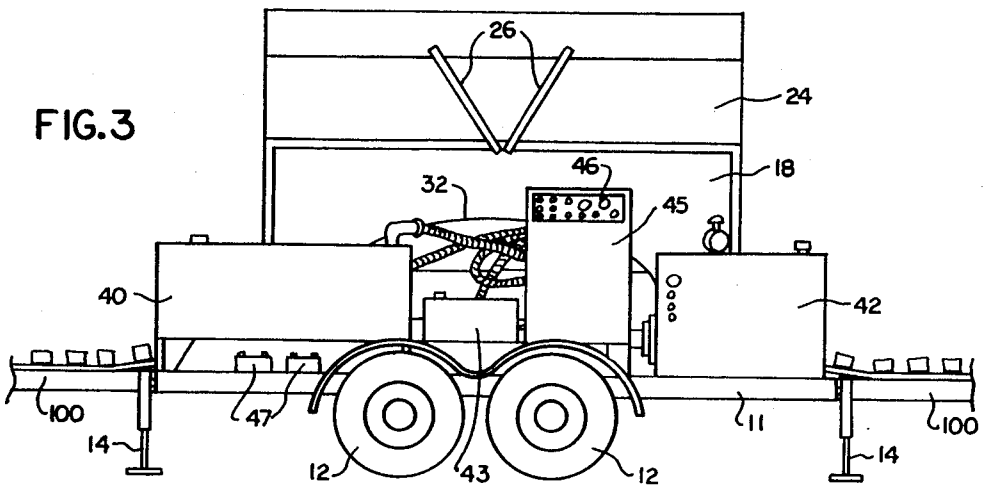
FIG. 3 is a side elevational view of the machine from the opposite side of FIG. 1 taken along line 3—3 of FIG. 2.
Figure 2:
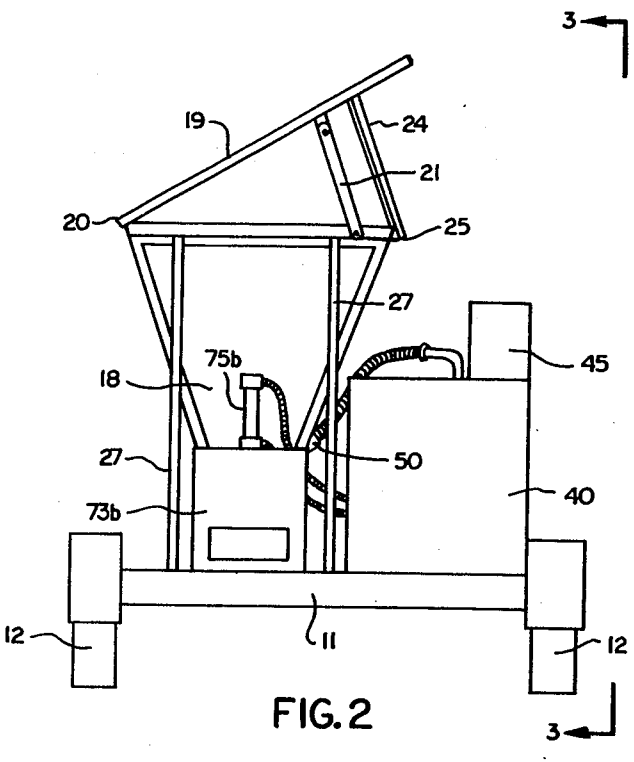
FIG. 2 is a front elevational view of the machine taken along line 2—2 of FIG. 1.

Referring more particularly to the drawings and initially to FIGS. 1–3, there is shown the machine of the present invention. The machine includes a frame 11 supported by a plurality of wheels 12. The machine is trailer-mounted, and a suitable trailer hitch may be provided at either end so that the machine may be easily transported from place to place. Preferably, the trailer connection is provided at the end to the right in FIG. 1 (to the left in FIG. 3), and therefore this end will be referred to as the front end.

Leveling jacks 14 may also be provided beneath the frame 11 at each end to stabilize the machine during operation.

Mounted on the frame 11 is a large hopper 18 into which earth may be placed. The hopper 18 has an open top which is covered by a large diagonally extending screen 19. The screen 19 keeps large foreign objects out of the hopper 18, such as large rocks and stumps. Smaller rocks can be accommodated in the formation of earth blocks, and therefore the mesh of the screen 19 is large enough to permit small rocks to be fed into the hopper 18 along with large clumps of earth. The screen 19 is connected to one side of the hopper 18 by a hinge at connection point 20. The screen 19 is held up by struts 21 located at each end of the hopper. A lid 24 is attached to the other side of the hopper 18 at a hinge point 25. The screen 19 may be folded down at its hinge point 20 and the lid 24 folded down on its hinge point 25 to lower the profile of the machine and decrease its height for transport and shipping. When the machine is placed in its position for operation, the screen 19 is raised and the lid 24 is raised to support the screen and the struts 21 are put into place. The top of the screen 19 is also supported by struts 26 extending from the side of the hopper 18 adjacent the lid 24. The hopper 18 is supported on the frame 11 by four upstanding support members 27, two of which are located at each end of the frame.

The hopper 18 has a pair of outlets 31 at the bottom, one outlet at each end of the hopper. The hopper 18 also has a curved bottom 32 between the two outlets 31 so that earth in the hopper is fed to the two outlets 31. The space beneath the curved hopper bottom 32 may be used to provide an accessory compartment into which various tools can be stored. Beneath each of the hopper outlets 31 is a mold assembly 34*a* or 34*b* for forming the earth blocks. Two mold assemblies 34*a* and 34*b* are thus provided, one at each end of the machine.

The hopper 18 has sloped sidewalls as shown in FIG. 2 and a curved bottom 32 as shown in FIGS. 1 and 3 to promote the flow of earth downwardly toward the outlets 31 to the mold assemblies 34*a* and 34*b*. To assist in the flow of earth, vibrators 49 and 50 may be mounted on the side of the hopper adjacent to each outlet 31. The vibrators 49 and 50 are preferably driven by the hydraulic system and include hydraulic motors. The vibrators 49 and 50 are needed because the earth will "bridge" and not feed downwardly through the outlets 31. The vibrators 49 and 50 break up this "bridging" and promote the flow of earth downwardly through the outlets. Suitable vibrators are available from Vibco, Inc. of Wyoming, Rhode Island, U.S.A. The vibrators provide approximately 3,300 oscillations per minute in a timed sequence to keep the earth constantly moving through the outlet of the hopper.

The hopper should hold approximately 84 cubic feet (2.4 cubic meters) of earth. This would be approximately ten minutes production of blocks. The hopper is directly mounted to the frame 11 by the supports 27 and is not connected to the mold assemblies 34*a* and 34*b*, so that it may be freely vibrated by the vibrators 49 and 50 without such vibrations being transmitted to the molds.

On the frame 11 opposite the hopper 18 are the hydraulic and electrical components of the machine. The hydraulic system includes a hydraulic fluid reservoir tank 40 located at the front of the frame 11 and a diesel engine 42 located at the rear of the frame. The hydraulic reservoir tank 40 preferably has a capacity of about 150 gallons (568 liters) and should be continuously filtered to ten microns to avoid contamination. The engine 42 is preferably a diesel engine capable of delivering approximately 46 h.p. (34 kilowatts with an extra heavy duty capacity radiator. The engine 42 runs the hydraulic pumps to power the hydraulic system and also provides a radiator with a fan for cooling the hydraulic fluid. The engine 42 is mounted to the frame 11 with isolation type engine mounts which avoid metal to metal contact. This keeps engine vibration from being transferred to other parts of the machine. A diesel fuel tank 43 is used to store fuel for the engine 42. An enclosure 45 located between the engine 42 and the fuel tank 43 contains the electrical control apparatus. Controls 46 are located on the exterior of the enclosure 45. The electrical control apparatus is powered by batteries 47 located beneath the reservoir 40. Between the enclosure 45 and the hopper 18 are the other components of the hydraulic system including pumps, lines and valves, all of which will be described more fully later with reference to FIG. 6. The pumps operate on a power take-off from the engine 42 and are connected directly to the engine.

Figure 4:
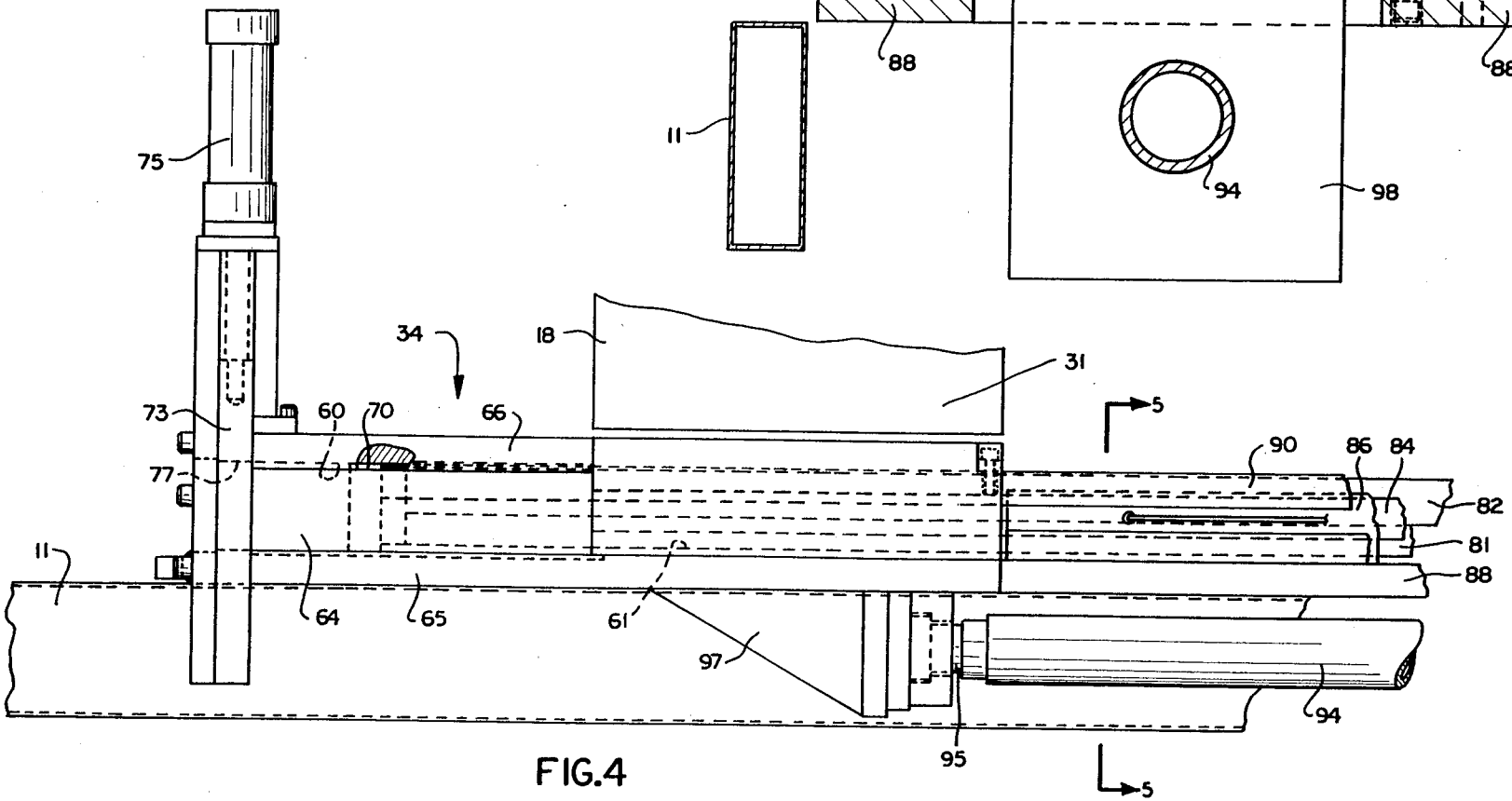
FIG. 4 is a side elevational view, partially in section of the mold at the left side of FIG. 1 to a larger scale.

Both mold assemblies 34*a* and 34*b* are substantially identical, and both will be described with reference to the mold assembly 34 shown in FIG. 4. The mold assembly 34 comprises a forward chamber or mold 60 and a feed chamber 61 located directly behind the mold 60. The mold 60 and the feed chamber 61 are both formed from a pair of sidewalls 64 and a bottom 65. The mold 60 also includes a top 66. The feed chamber 61 does not have any top and is open to receive earth from the outlet 31 of the hopper 18. The inside walls of the mold 60 should be heat treated to a Rockwell RC hardness of 58 for wear resistance.

A ram head 70 moves horizontally through the feed chamber 61 and into the mold 60. The ram head 70 may be fully retracted from the mold 60 and from the feed chamber 61 to permit earth to fall into the feed chamber 61. The ram head 70 is then advanced through the feed chamber 61 and into the mold 60 to compress the earth in the mold 60 to form a block.

The earth is compressed against an end wall formed by a gate 73. The gate 73 is vertically movable by means of a hydraulic cylinder 75 located above the gate. The top of the gate 73 is attached to the piston which moves up and down within the hydraulic cylinder 75. A window 77 is provided in the upper portion of the gate 73. When the window 77 is aligned with the mold 60 as shown in FIG. 4, the block formed in the mold 60 may be extruded from the mold by the ram head 70 through the window 77 in the gate 73. When the gate 73 is lifted by actuation of the hydraulic cylinder 75, the window 77 moves upwardly and a solid end wall is formed by the lower portion of the gate 73 to prevent earth from escaping from the mold 60. The lower portion of the gate 73 thus provides a firm end wall against which earth is compacted by the advancing ram head 70.

The window 77 is provided in the upper portion of the gate 73 so that the gate 73 is opened by lowering the gate and closed by raising the gate. This is advantageous because opening the gate when the mold 60 contains a newly formed block is more difficult than closing the gate when the mold is empty. By moving the gate 73 downwardly to open the gate, the force of gravity assists at opening the gate.

Figure 5:
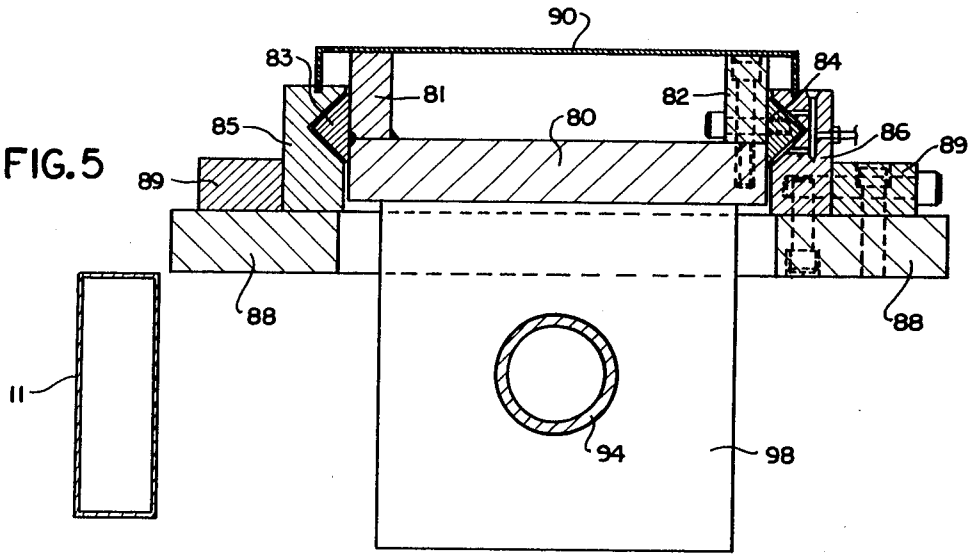
FIG. 5 is a cross-sectional view of the slide mechanism taken along line 5—5 of FIG. 4.

The ram head 70 is attached to the end of a slide member 80. As shown in FIG. 5, the slide member 80 includes a pair of upstanding flange members 81 and 82 which are welded to the slide member 80 and provide increased rigidity to the slide member 80 to prevent its buckling under the heavy forces which are experienced during the ramming operation. Track members 83 and 84 are welded to each side of the slide member 80. Each of the track members 83 an 84 is triangular in cross section and fits into a corresponding groove in longitudinally extending blocks 85 and 86. The blocks 85 and 86 are supported on a support frame 88 which extends along and beneath the slide member 80 and is rigidly attached to the frame 11 of the machine. Reinforcing blocks 89 may be provided to provide added rigidity between the blocks 85 and 86 and the support frame 88. A top 90 extends over the slide member 80 and protects the bearing between the track members 83 and 84 and the blocks 85 and 86 and prevents dirt from entering this area. The top 90 also extends completely to the ram head 70 to prevent earth from the hopper outlet 31 from entering the feed chamber 61 when the ram head 70 is advanced into the mold 60.

A hydraulic cylinder 94 is mounted beneath the support frame 88. The cylinder 94 has a piston which is connected to a piston rod 95 extending from each end of the cylinder 94. Each end of the piston rod 95 is rigidly connected to the support frame 88 by means of a support member 97. The cylinder 94 is rigidly connected to the slide member 80 by means of a connecting block 98 shown in FIG. 5. Thus, the piston in the cylinder 94 is rigidly connected at each end to the fixed support frame 88 while the cylinder 94 is connected to the movable slide member 80, and the cylinder 94 moves back and forth as hydraulic fluid is supplied on each end of the piston.

The slide member 80 is thus connected between the two ram heads 70 and absorbs and transmits all of the force necessary to provide the pressure to the earth to form blocks in the molds 60. The hydraulic cylinder 94 is mounted out of the line of the force transmitted directly between the two ram heads 70. Thus the cylinder 94 is not located in the force line between the two ram heads and as a result is subjected to less stress and less wear.

The mold 60 will typically produce blocks measuring 12 inches by 4 inches (30 cm. by 10 cm.) and approximately ten inches (25 cm.) long. The length of the blocks can be adjusted by adjusting the retraction of the ram head 70 or by adjusting the size of the hopper outlet 31 or adjusting the amount of earth fed from the hopper into the feed chamber 61.

If desired, a pair of conveyors 100 (FIGS. 1 and 3) may be attached at each end of the machine upon which the formed blocks exiting through the gates 73*a* and 73*b* may roll. Each conveyor 100 should be about ten feet (3 meters) long with skate wheels, and should be galvanized for weather protection.

Figure 6:
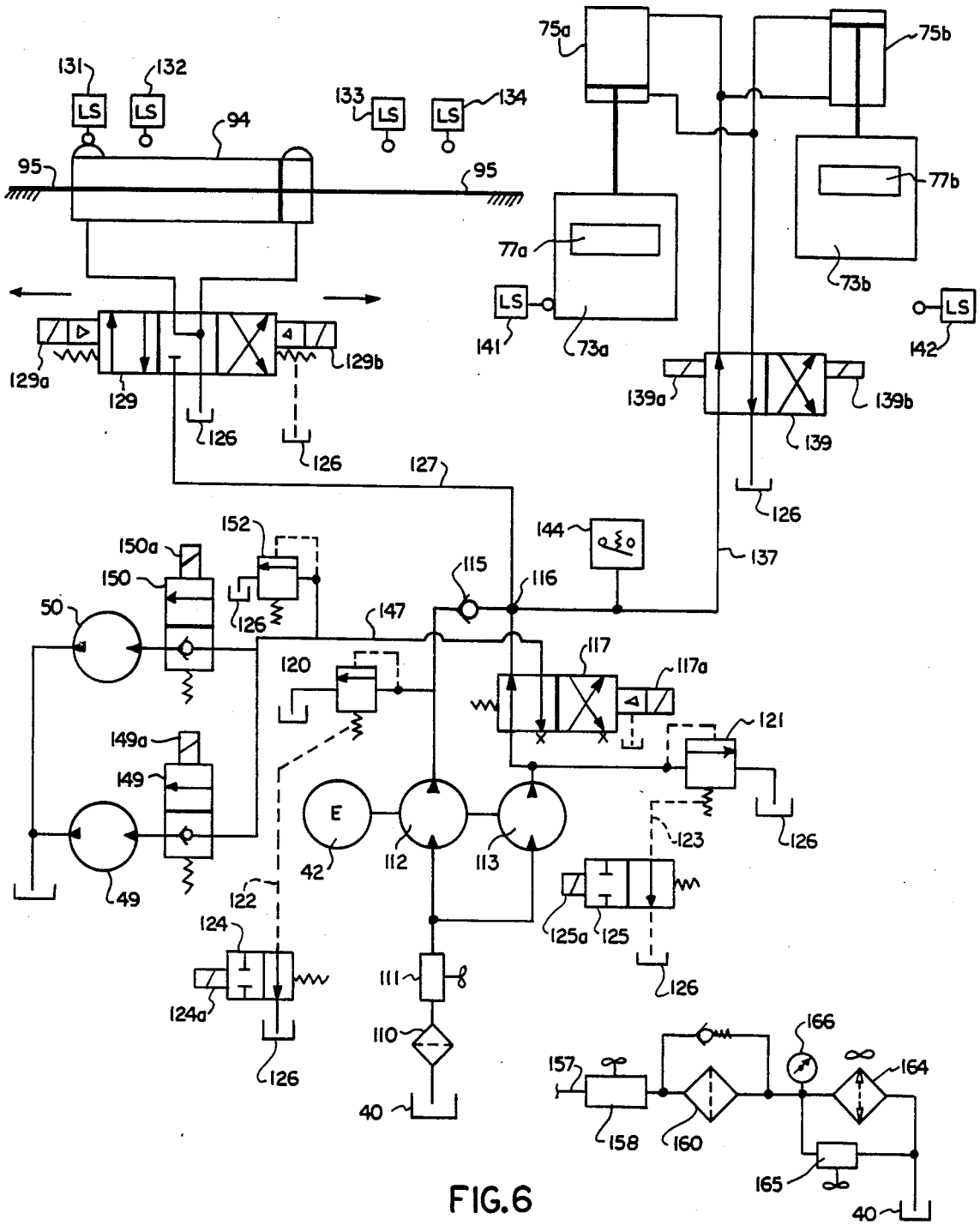
FIG. 6 is a schematic drawing of the hydraulic system of the machine of FIGS. 1–5.

The hydraulic system is shown schematically in FIG. 6. Hydraulic fluid is provided from the reservoir 40 through a filter 110 and a directional valve 111 to a pair of fixed displacement unidirectional pumps 112 and 113. The pumps 112 and 113 are both powered by the engine 42. The pump 112 is a high-displacement, low-pressure pump capable of delivering 80 G.P.M. (300 liters/min.) of hydraulic fluid at a maximum of 1,000 psi (70 kg./sq. cm.). The pump 113 is a high-pressure low-displacement pump capable of delivering hydraulic fluid at pressures at least up to 2,000 psi (140 kg./sq. cm.), and preferably up to 3,000 psi (210 kg./sq. cm.). The output of the high displacement pump 112 is supplied through a check valve 115 to a manifold located at a point designed as 116 in FIG. 6. The output of the high pressure pump 113 is supplied through a valve 117 to the manifold 116.

The output of the two pumps 112 and 113 is selected by means of a pair of relief valves 120 and 121. Each of the relief valves 120 and 121 is enabled by a pilot line connected to a solenoid valve 124 and 125. The valve 124 is actuated by a solenoid 124*a*, and the valve 125 is actuated by a solenoid 125*a*. When the solenoid valve 124 is in its normal position as shown in FIG. 6, the relief valve 120 is enabled and the output of the high-displacement pump 112 will be automatically relieved. When the solenoid 124*a* of the valve 124 is actuated, the pilot line from the relief valve 120 is blocked, and the relief valve 120 is prevented from opening to relieve the output of the high-displacement pump 112. The fluid in the manifold 116 is not relieved through the valve 120 because of the check valve 115. When the solenoid valve 126 is in its normal position as shown in FIG. 6, the relief valve 121 is enabled and the output of the high-pressure pump 113 will be automatically relieved. When the solenoid 125*a* of the valve 125 is actuated, the pilot line 123 is closed disabling the relief valve 121 and preventing the output from the high-pressure pump 113 from being relieved. The relief valve 121 is set at a sufficient high pressure so that it will only relieve the high pressure output of the pump 113 and will not relieve the low-pressure output of the high-displacement pump 112.

The pilot lines connected to each of the relief valves 120 and 121 drain into a return reservoir 126, except when the solenoid valve 124 or 125 associated with the relief valve is actuated to block the drain.

Fluid from the manifold 116 is supplied through a line 127 to actuate the main ram cylinder 94. The line 127 is connected to a three-position, dual-solenoid valve 129 which is spring centered and includes an internal pilot. The two lines from one side of the valve 129 are connected to the cylinder 94 on each side of the piston. The two lines on the other side of the valve are connected to the line 127 and to the return reservoir 126. As previously described, the piston rod 95 extends from both ends of the cylinder 94 and is fixedly attached to the frame of the machine so that the cylinder 94 moves back and forth as hydraulic fluid is supplied on each side of the piston.

As the cylinder 94 moves, it engages a plurality of limit switches 131, 132, 133 and 134 positioned along its line of travel. The limit switches 131 and 134 are used to indicate that the cylinder 94 has reached its most advanced position with the ram head 70 through the window 77 in the gate 73 to extrude the block from the mold. The limit switches 132 and 133 are used to indicate that the cylinder 94 is in a position in which the ram head 70 is clear of the window 77 and the gate 73 may be closed. When the solenoid 129*a* is actuated to move the valve 129 to the right as shown in FIG. 6, the line 127 is connected to the left side of the cylinder 94, the cylinder 94 will be moved to the left, and the return fluid from the right of the cylinder 94 is connected to the return reservoir 126. When the solenoid 129*b* is actuated to move the valve 129 to the left as shown in FIG. 6, the line 127 is connected to the right side of the cylinder 94, the cylinder is moved to the right, and the return fluid from the left of the cylinder 94 is connected to the return reservoir 126.

The manifold 116 is also connected by means of a line 137 to the cylinders 75*a* and 75*b* which actuate the gates 73*a* and 73*b*. A two-position solenoid valve 139 selects which of the cylinders 75*a* or 75*b* will be actuated down or up. When the solenoid 139*a* is actuated and the valve 139 is moved to the right as shown in FIG. 6, the line 137 is connected to the top of the left cylinder 75*a* so that the left gate 73*a* is moved downwardly and the window 77*a* in the left gate 73*a* aligns with the outlet of the left mold to open the mold and permit the block formed in the left mold to be extruded through the window 77*a*. At the same time, the line 137 is connected to the bottom of the right cylinder 75*b* to raise the right gate 73*b*, so that the right gate 73*b* provides a fixed end wall for the right mold, and the right mold is closed. When the solenoid 139*b* is actutated, the valve 139 is moved to the left as shown in FIG. 6, and the line 137 is connected to the top of the right cylinder 75*b* to lower the right gate 73*b* and open the mold at the right end of the machine, so that the formed block can be extruded from the right mold. At the same time, the line 137 is connected to the bottom of the left cylinder 175*a* so that the left gate 73*a* is raised to close the end of the left mold. The return fluid from the cylinders 75*a* and 75*b* is connected to the return reservoir 126.

Limit switches 141 and 142 are provided to sense when the gates 73*a* and 73*b* are in their lowered or opened positions. When the limit switch 141 is actuated, the left gate 73*a* is in its lowermost or open position. When the right gate limit switch 142 is actuated, the right gate 73*b* is in its lowermost or open position.

A pressure switch 144 is also connected to the manifold 116. The pressure switch 144 senses when the pressure of the hydraulic fluid in the manifold 116 has increased above the capabilities of the high-displacement low-pressure pump 112. The high-displacement pump 112 provides fluid for rapid movement of the cylinder 94 when the cylinder is not subjected to significant loads. When the cylinder 94 begins pushing the ram head to form the block, the cylinder begins to be experience loading, and the pressure of the fluid supplied to the cylinder begins to increase. The pressure switch 144 senses this pressure increase, and the output of the pressure switch is used to enable the high-pressure pump 113 to be used to supply fluid to the cylinder 94 at higher pressures.

The output of the high-pressure pump 113 is also supplied to the vibrators 49 and 50 upon the actuation of the valve 117. The valve 117 is a two-position valve actuated by a solenoid 117*a* and by an internal pilot with a spring return. When the valve 117 is in its normal position as shown in FIG. 6, the output of the high-pressure pump 113 is supplied to the manifold 116. When the solenoid 117*a* is actuated, and the valve 117 is moved to the left as shown in FIG. 6, the output of the high-pressure 113 is supplied in a line 147 to the vibrators 49 and 50 through a pair of solenoid valves 149 and 150.

Each of the valves 149 and 150 has a solenoid 149*a* and 150*a* to actuate the valve, and each is spring returned. In its normal position as shown in FIG. 6, each solenoid valve 149 and 150 includes a check valve to prevent return flow. The solenoid valves 149 and 150 select which of the vibrators 49 or 50 will be actuated. When the solenoid 149*a* is actuated, and the valve 149 is moved downwardly as shown in FIG. 6, the left vibrator 49 is turned on, and the outlet at the left side of the hopper is vibrated. When the solenoid 150*a* is actuated, and the valve 150 is moved downwardly as shown in FIG. 6, the vibrator 50 is actuated, and the earth at the outlet at the left side of the hopper is vibrated. The line 147 includes a relief valve 152 to prevent exposing either of the vibrators 49 or 50 to excess hydraulic pressures.

The return hydraulic flow from each of the returns 126 is fed by a line 157 to the reservoir 40 through a directional valve 158, a filter 160, and a heat exchanger 164. The heat exchanger 164 is preferably mounted on the front of the diesel engine 42 and includes a fan which operates directly from the engine. A heat sensitive control valve 165 is connected around the heat exchanger 164. When the temperature fluid reaches 140° F., (60° C.) the heat sensitive control valve 165 opens, sending hydraulic fluid through the heat exchanger 164 to be cooled. This is desirable as in cold climates and without the valve, fluid would stay cool and never get to the operating temperature of approximately 115° F. (46° C.). A pressure gauge 166 may also be provided in the line 157.

Figure 7:
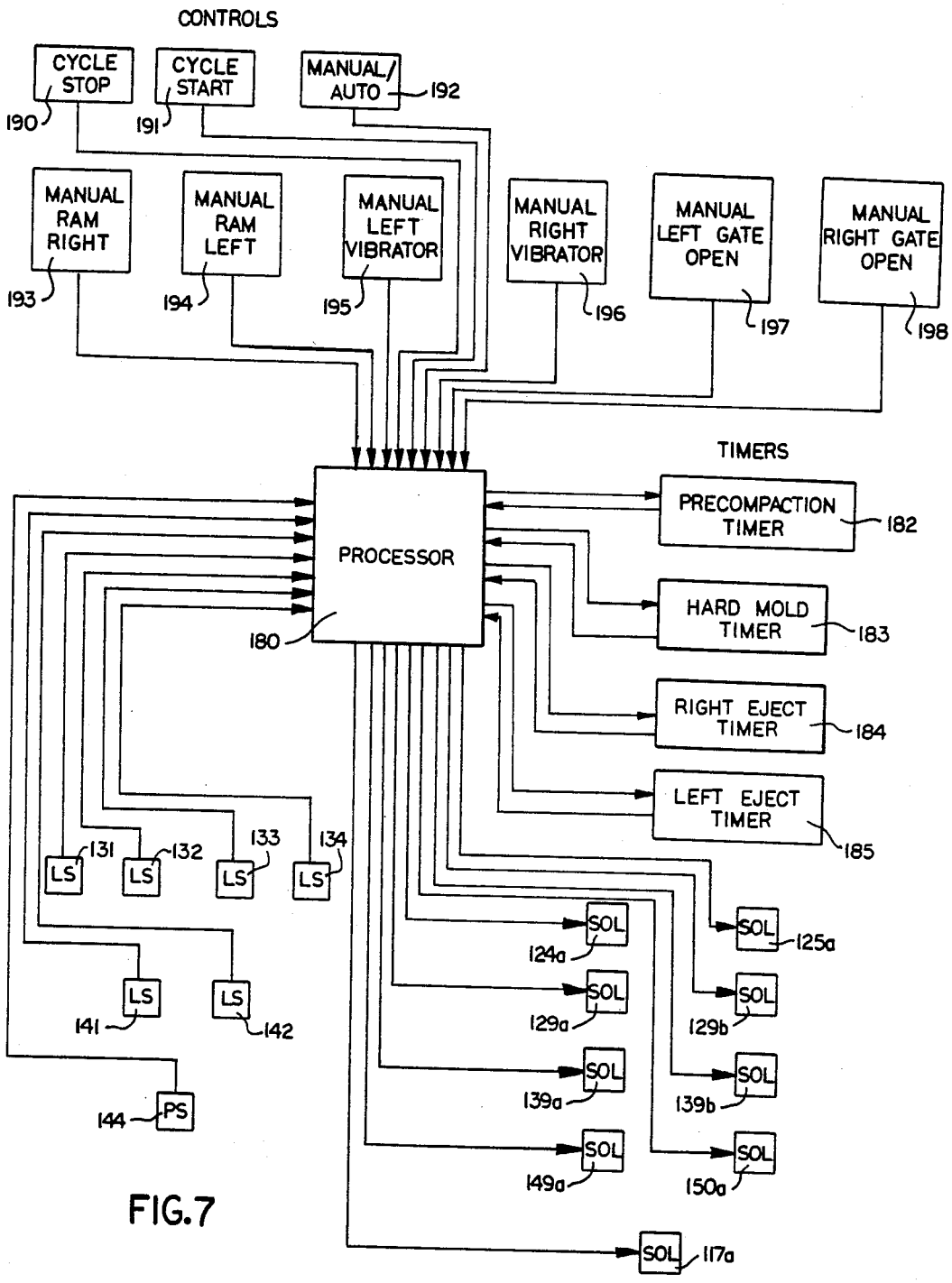
FIG. 7 is a schematic drawing of the control system of the machine of FIGS. 1–6.

The control system of the machine of the present invention may be understood with reference to FIG. 7. The heart of the control system is a central processor 180. The processor 180 may be any suitable microprocessor or other similar programmable controller. A processor which has been found to be suitable for use in this machine is the Automate 15 Programmable Controller manufactured by Reliance Electric Company, Cleveland, Ohio U.S.A. The limit switches 131–134 and 141 and 142 are connected to the central processor 180, as is the pressure switch 144. The central processor 180 is connected to control the solenoids 117*a*, 124*a*, 125*a*, 129*a*, 129*b*, 139*a*, 139*b*, 149*a* and 150*a*. The central processor 180 is also connected to timers 182, 183, 184 and 185 which operate certain delays which occur in the automatic operation of the machine. The timers 182–185 may conveniently be designed as part of the processor 180. However, for the sake of clarity, the timers are shown as separate elements in FIG. 7.

The central processor 180 is also connected to a plurality of controls which are used to operate the machine. The basic controls are a "cycle stop" control 190 and a "cycle start" control 191, and a "manual/auto" control 192. Controls 190–192 are the only controls necessary to operate the machine in an automatic mode. In addition, there are six manual controls 193–198 which are used to operate the machine in a manual mode. These controls 193–198 are only operable when the "manual/auto" control 192 is set to indicate the manual mode. When the control 192, selects the manual mode, the "manual ram right" control 193 operates to move the ram to the right by actuating the solenoid 129*b* while actuating both of the solenoids 124*a* and 125*a*. Likewise, the "manual ram left" control 194 when actuated moves the cylinder 94 to the left by actuating the solenoid 129*a* while actuating both of the solenoids 124*a* and 125*a*. The "manual left vibrator" control 195 turns on the left vibrator 49 by actuating the solenoids 117*a*, 125*a*, and 149*a*. The "manual right vibrator" control 196 actuates the right vibrator 50 by turning on the solenoids 117*a*, 125*a*, and 150*a*. The "manual left gate open" control 197 opens the left gate 73*a* by actuating the solenoids 125*a* and 139*a*, as long as the limit switch 132 is not actuated. The "manual right gate open" control 198 opens the right gate 73*b* by actuating the solenoids 125*a* and 139*b* as long as the limit switch 133 is not actuated.

When the "manual/auto" control 192 is set to indicate the automatic mode, the machine functions completely automatically to produce blocks from earth at each end of the machine, and further use of the manual controls is unnecessary. With the "manual/auto" control 192 in the auto mode, this automatic sequence of operations is initiated by actuating the "cycle start" control 191. The machine then functions as follows.

If the cylinder 94 is positioned to the left as shown in FIG. 6, and the left arm limit switch 131 is actuated and if the left gate 73*a* is down (i.e., open) so that the left gate limit switch 141 is actuated, the automatic cycle begins with the movement of the ram to the right. The processor 180 first checks to be sure that the right gate limit switch 142 is not actuated, indicating that the right gate 73*b* is up, and that the right mold is closed so that a block may be formed against the solid end wall provided by the raised right gate 73*b*. The solenoid 129*b* is then actuated to move the valve 129 to the left as shown in FIG. 6, enabling the cylinder 94 to move to the right with fluid from the manifold 116. At the same time, the solenoids 124*a* and 125*b* are closed, so that the output of both pumps 112 and 113 is supplied to the manifold 116.

The cylinder 94 moves to the right and moves the right ram head into the right mold to compress the earth in the mold. As the ram head encounters the earth and resistance to further movement of the ram head increases, the pressure of the hydraulic fluid supplied to the cylinder 94 through the line 127 increases. This increased pressure eventually actuates the pressure switch 144. When the pressure switch 144 is actuated, it initiates the precompaction timer 182. When the timer 182 times out, the solenoid 124*a* is deactuated to allow the valve 124 to close and enable the relief valve 120 to relieve the output of the high-displacement pump 112. The hydraulic fluid then supplied to the manifold 116 is only high-pressure fluid supplied from the pump 113. The cylinder 94 continues to move to the right with high pressures applied to the earth in the right mold.

At the same time that the solenoid 124*a* is deactuated and the cylinder begins running off the high pressure fluid from the pump 113, the hard mold timer 183 is actuated. When the timer 183 times out, the solenoid 139*b* is actuated to move the valve 139 to the left as shown in FIG. 6 and lower the right gate 73*b* and open the gate. When the right gate 73*b* is lowered, the left gate 73*a* is raised, so the processor 180 checks to be sure that the limit switch 133 is not actuated before lowering the right gate 73*b*. When the right gate 73*b* is lowered and the right gate limit switch 142 is actuated, the solenoid 124*a* is again actuated, and the right eject timer 184 is initiated. The cylinder 94 continues to move to the right. When the timer 184 times out, the high pressure output of the pump 113 is supplied to the left vibrator 49. By actuating the solenoid 117*a* to move the valve 117 and actuating the solenoid 150*a* to move the valve 150.

With the right gate 73*b* open, the ram 94 continues to move to the right using the output of the pump 112 to eject the formed brick through the window 77*b* in the gate and out of the mold. The cylinder 94 continues to move to the right until it actuates the right ram limit switch 134. When the right ram limit switch 134 is actuated, further movement of the cylinder 94 is halted by deactuating the solenoid 129*b*, and the left vibrator 49 is turned off by deactuating the solenoids 149*a* and 117*a*.

The actuation of the limit switches 134 and 142 then initiates the complementary cycle of the cylinder 94 in which the cylinder is moved to the left. The cycle follows following essentially the same steps as those outlined for movement of the cylinder to the right. The solenoid 129*a* is actuated to move the valve 129 to the right as shown in FIG. 6 and both solenoids 124*a* and 125*a* are actuated, so that hydraulic fluid is supplied from both pumps 112 and 113 to the left side of the cylinder 94. This moves the cylinder 94 to the left. When the left ram head encounters the earth in the left mold, and the resistance to movement of the cylinder increases, the pressure switch 144 is actuated by the higher pressure in the hydraulic fluid, the precompaction timer 182 is initiated. When the timer 182 times out, and the high-displacement, low-pressure pump 112 is relieved through the relief valve 120 by deactuating the valve 124. At the same time the hard mold timer 183 is inititated, and when this timer times out, the solenoid 139*a* is actuated to open the left gate 73*a*. Before opening the left gate 73*a*, the processor 180 checks to assure that the limit switch 132 is not actuated so as to be sure that the right ram head is clear of the window 77*b* in the right gate 73*b* since the gate 73*b* is closed at the same time that the left gate 73*a* is opened. When the limit switch 141 is actuated indicating that the gate 73*a* is open, the solenoid 124*a* is again actuated, and the left eject timer 185 is initiated. When the timer 185 times out, the solenoids 117*a* and 150*a* are initiated to supply high-pressure hydraulic fluid from the pump 113 to the right vibrator 50*a*. The cylinder 94 continues to move to the left using the output of the pump 112 until the cylinder initiates the left ram limit switch 131 at which time the solenoid 129*a* is deactuated and further movement of the cylinder 94 stops.

The actuation of the limits switches 131 and 141 then initiates the cycle of movement of the cylinder 94 to the right as previously described. The cylinder 94 continues to move back and forth and the gates 73*a* and 73*b* continue to open and close as previously described with earth blocks being formed at each end of the machine.

The connections between the processor 180 and the various inputs and outputs shown in FIG. 7 would ordinarily be separated by suitable optical couplings so that the various inputs and outputs are electrically isolated from the processor 180.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A machine for making blocks from earth which comprises:

a pair of block forming molds;

a pair of reciprocal ram heads, each of the heads capable of being moved between a retracted position in which the head is removed from the mold and earth can fall into the mold, and an advanced position in which the head is moved into one of the molds and earth in the mold is compressed to form a block;

a slide member connecting the two rams heads, one of the heads being attached to each end of the slide member, the slide member being longitudinally movable to simultaneously move one ram head to its advanced position and the other ram head to its retracted position;

a support frame upon which the slide member is mounted for longitudinal movement; and a dual-action hydraulic cylinder having an internal piston, the cylinder and piston being attached to the slide member and support frame to move the slide member longitudinally with respect to the support frame, the cylinder being mounted away from the axis between the ram heads.

2. A machine for making blocks from earth as described in claim 1, wherein the cylinder is attached to the slide member and the piston is attached to the support frame.

3. A machine for making blocks from earth as described in claim 1, comprising in addition a hopper having two outlets, each of the outlets supplying earth to one of the pair of molds.

4. A machine for making blocks from earth as described in claim 1, comprising in addition a pair of movable gates, each of the gates closing one end of one of the molds.

5. A machine for making blocks from earth as described in claim 4, wherein each of the gates is movable to open one end of each of the molds to permit the block to be removed from the mold.

6. A machine for making blocks from earth as described in claim 5, wherein each of the gates is vertically movable between a raised position and a lowered position, and wherein each of the gates is open when it is in its lowered position.

7. A machine for making blocks from earth as described in claim 1, comprising in addition means for supplying hydraulic fluid to the cylinder, the supplying means including first means for selectably supplying fluid at low pressure and high volume, and second means for selectably supplying fluid at high pressure.

8. A machine for making blocks from earth as described in claim 7, wherein the second supplying means supplies hydraulic pressure at pressures in excess of 2,000 psi.

9. A machine for making blocks from earth as described in claim 7, comprising in addition a pressure switch associated with the supply means for sensing when the pressure of the hydraulic fluid from the first supplying means has increased so that the second supplying means may be selected.

10. A machine for making blocks from earth as described in claim 3, comprising in addition a pair of vibrators mounted on the hopper to vibrate the earth in the hopper to facilitate the feeding of earth from the outlets into the molds, one of the vibrators mounted adjacent to each of the outlets.

11. A machine for making blocks from earth, which comprises:

a pair of block forming molds, each having a bottom and two sides;

a pair of movable gates, each of the gates closing one end of the molds;

a pair of reciprocal ram heads, each of the heads capable of being moved between a retracted position in which the head is removed from the molds and earth can fall into the mold, and an advanced position in which the head is moved into one of the molds and earth in the mold is compressed to form a block;

a slide member connecting the two ram heads, one of the heads being attached to each end of the slide member, the slide member longitudinally movable to simultaneously move one ram head to its advanced position and the other ram head to its retracted position;

a support frame upon which the slide member is mounted for longitudinal movement;

a dual-action hydraulic cylinder having an internal piston, the cylinder being attached to the slide member and the piston being attached to the support frame to move the slide member longitudinally with respect to the support frame, the cylinder being mounted away from the axis between the ram heads; and means for supplying hydraulic fluid to the cylinder, the supplying means comprising a first low-pressure high-displacement supplying means for moving the cylinder rapidly at low pressure, and a second high-pressure supplying means for moving the cylinder slowly at high pressures in excess of 2,000 psi.

12. A machine for making blocks from earth as described in claim 11, wherein each of the gates is vertically movable between a raised position and a lowered position, and wherein each of the gates is open when it is in its lowered position.

13. A machine for making blocks from earth as described in claim 11, comprising in addition a pressure switch associated with the supply means for sensing when the pressure of the hydraulic fluid from the first supplying means has increased so that the second supplying means may be selected.

14. A machine for making blocks from earth as described in claim 11, comprising in addition a hopper having two outlets, each of the outlets supplying earth to one of the pair of molds.

15. A machine for making blocks from earth as described in claim 14, comprising in addition a pair of vibrators mounted on the hopper to vibrate the earth in the hopper to facilitate the feeding of earth from the outlets into the molds, one of the vibrators mounted adjacent to each of the outlets.

* * * * *